United States Patent [19]

Dempsey

[11] 3,937,505

[45] Feb. 10, 1976

[54] ELECTRIC HOOD LATCH FOR VEHICLES

[75] Inventor: Edward Dempsey, Bronx, N.Y.

[73] Assignee: Lawrence Peska Associates, Inc., New York, N.Y. ; a part interest

[22] Filed: Mar. 13, 1974

[21] Appl. No.: 450,825

[52] U.S. Cl. ..... 292/201; 292/246

[51] Int. Cl.[2] ..... E05C 3/30

[58] Field of Search ..... 70/241; 292/129, 144, 201, 292/246

[56] References Cited

UNITED STATES PATENTS

| | | | |
|---|---|---|---|
| 1,057,608 | 4/1913 | Wurmb et al. | 292/201 |
| 1,199,199 | 9/1916 | Mason | 292/201 |
| 3,135,541 | 6/1964 | Kwasek | 292/201 X |
| 3,751,086 | 8/1973 | Geringer | 292/144 |

FOREIGN PATENTS OR APPLICATIONS

| | | | |
|---|---|---|---|
| 1,038,624 | 8/1966 | United Kingdom | 292/201 |
| 5,599 | 3/1907 | United Kingdom | 292/201 |

*Primary Examiner*—Richard E. Moore
*Attorney, Agent, or Firm*—Richard E. Nanfeldt

[57] ABSTRACT

A hood locking device for vehicles for locking the hood over the engine compartment to prevent theft of the vehicle or of engine parts. It includes a main housing mountable inside the compartment by adjustable rods and brackets to fit most cars or trucks, there being an upper locking post securable to the hood and having a locking finger on its lower end which extends inside the main housing when the hood is lowered. The main housing has an elongated locking bar with an El shaped foot at its lower end, and being pivoted intermediate its ends. An electromagnet is energized from the car battery to swing the elongated locking bar for its upper end to engage with the locking finger to lock the hood. A modified form has the magnetic means energized to unlock the hood.

6 Claims, 6 Drawing Figures

ELECTRIC HOOD LATCH FOR VEHICLES

This invention relates to improvements in locking devices for vehicle hoods and the like.

An object of the invention is to provide a novel and improved locking device for portions of vehicles, such as their hoods, especially to prevent theft.

Another object of the invention is to provide a novel and improved hood locking device in which electrical means and cooperating mechanical means are used for operating the lock.

A further object of the invention is to provide a novel and improved hood locking device for vehicles, in which there is one lock portion which is permanently attached to the hood, and a latching mechanism which is permanently attached to the vehicle body or chassis, so that when these two portions are mutually engaged with each other, the hood is securely locked against opening by unauthorized persons.

Still another object of the invention is to provide a novel and improved hood locking device in which there is a locking mechanism housing secured to the vehicle frame, chassis or other fixed portion under the hood, with a movable latch member inside the housing for movement into and out of locking engagement with a bar member carried by the hood which extends inside the housing on closing of the hood, and electromagnetic means in the housing for engaging the latch member with the bar member to lock the hood.

Still a further object of the invention is to provide a novel and improved hood locking device which is formed of few parts, and can be made at low cost by mass production methods for use in most motor vehicles.

The above and other objects and advantages of the invention will become apparent from the following description of a preferred embodiment thereof, as illustrated in the accompanying drawings.

Figure 1:
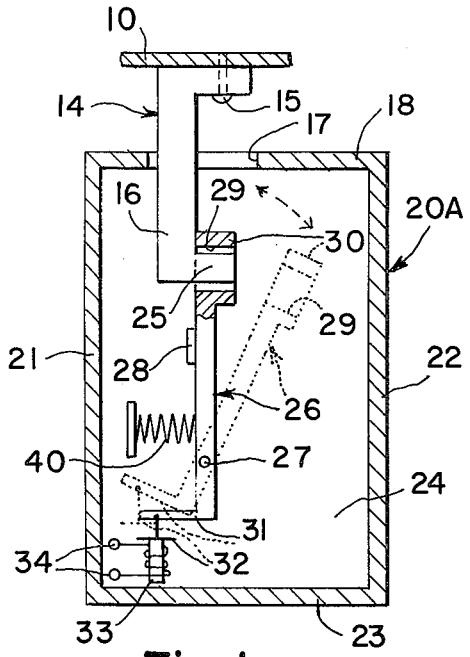
FIG. 1 is a sectional elevational view of the locking mechanism in engagement with the hood of the vehicle.

In connection with the use of motor vehicles, it has been found that where the hood over the engine compartment is easily opened, or even left unlocked, the vehicle is subject to being stolen, or engine parts removed from under the hood. On many cars, there is only a simple hand operated latch under the front end of the hood, which anyone can release to unlock the hood. While this is a convenience for a service station attendant to lift up the hood to add water to the radiator and transmission oil, it may account for the great many thousands of cars that are stolen every year.

Once they can open the hood, many thieves are adept at starting the car by jumping the ignition even though the ignition key has been removed. Further, they also can and do steal the battery, radio and other parts for resale to fences. The present invention is intended to prevent thieves or other unauthorized persons from opening the hood, and is so designed as to be used on most modern vehicles, without alteration of the car itself.

In order to understand clearly the nature of the invention, and the best means for carrying it out, reference may be had to the drawings, in which like numerals denote similar parts throughout the several views.

As shown there is a vehicle hood 10 which is commonly hinged over the engine compartment of the car body 12. A locking bar 14 is secured to the hood 10 by bolts 15 at one end with its shank portion 16 depending from the hood so that when the hood is lowered to close it, the shank 16 extends through the opening 17 in the roof portion 18 of the locking mechanism housing 20A or 20B, shown respectively in FIGS. 1 and 2.

Figure 2:
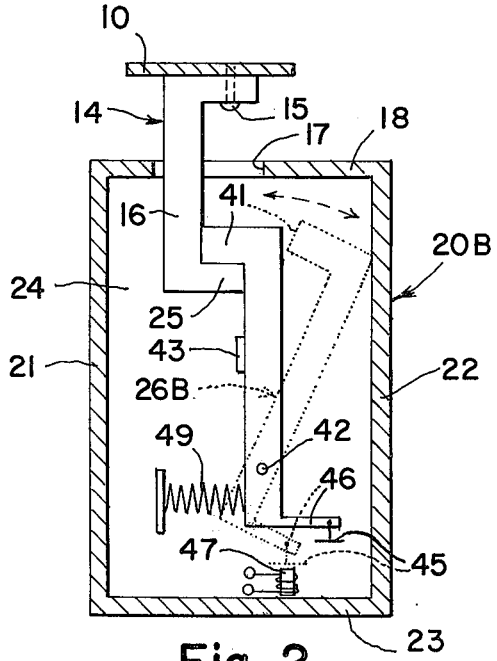
FIG. 2 is a sectional elevational view of a modified form of the locking mechanism in engagement with the hood.

The housings 20A and 20B are similar in construction, and have side walls 21 and 22, and floor wall 23 to form an interior chamber 24. As shown in FIGS. 1 and 2, the locking bar 14 is EL shaped at the bottom to form a finger 25. To lock the hood, it is necessary to engage this locking finger, and this is done as seen in FIG. 1, by means of the upright detent or latch bar 26 which is pivotally supported on fixed pivot pin 27 supported in a wall of the chamber 24, so that the latch bar 26 can swing from its full line position against the stop plate 28, to the broken line unlocked position shown at 26B of FIG. 2.

The latch bar 26 has a hole 29 formed through its enlarged upper end portion 30 to receive the locking finger 25, and thus to lock the hood against upward movement. The latch bar 26 also has a right angle extension foot 31 at its base, from which is suspended an iron or steel metal swing plate 32 by a wire or rod. An electromagnet 33 has its terminals 34 connected by wires to receive electric current from the battery 35 of the vehicle or from other batteries used for the locking device.

The electromagnet 33 being located beneath the swing plate 32, the action is that when the magnet is activated the metal plate is pulled down, and a small downward movement of the plate 32 produces a wide swing of the vertical bar 26 near its top end, moving the vertical bar 26 over and around the detent foot 25 of the depending bar 14. The latch bar 26 is designed so that it is top-heavy, and the metal stop 28 prevents it from reaching the absolute vertical. When the electromagnet is deactivated, the vertical bar 26 falls of its own weight out of the vertical, disengaging from foot 25 and releasing the hood to be opened. As seen in FIG. 1, a spring 40 may also be installed to aid in the falling of the bar 26 to the unlocked position.

FIG. 2 shows a modified form of the invention in which the upright latching bar 26B has a right angle extension leg 41 on its upper end instead of the apertured portion of the bar shown in FIG. 1, and this will overlap the angle base 25 of the depending bar 14 coming from the hood of the car. In this arrangement, the latching bar 26B is pivoted on fixed pivot pin 42, so it can move from full line locked position against stop plate 43 to its broken line unlocked position shown in the view.

A metal iron or steel swing plate 45 is suspended from the lower leg 46 of latching bar 26B in position to be attracted and pulled down on activation of the electromagnet 47 which is connected by wires from its terminals to the car battery through appropriate switches or as described below. In this form, the electromagnet unlocks the hood when it is energized, the spring 49 biasing the bar 26B counterclockwise as seen.

Figure 5:
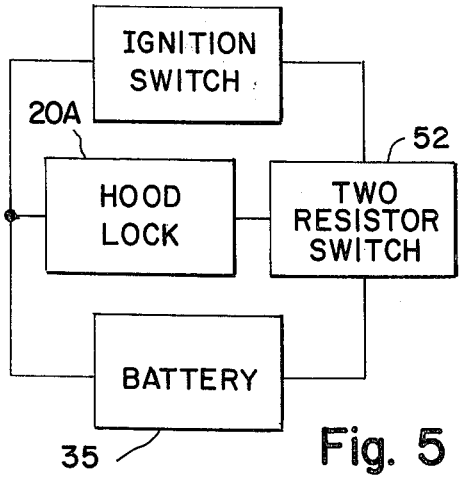
FIG. 5 is a block and schematic diagram showing a form of the invention in which the electromagnet locks the hood.

As seen in FIG. 5, the current to the electromagnet is controlled by the ignition switch and a two resistor switch. When the ignition is on, the current flows through the ignition and returns to the battery. When the ignition is off, the current switches to the hood lock by means of the two resistor switch. In the two resistor switch, the resistance in the main circuit leading to the ignition is slightly less than the resistance in the circuit leading to the hood lock.

The advantage of this system is that the hood is automatically locked as soon as the ignition is turned off, making the system convenient, and immune to the forgetfulness of the operator. Another advantage is that the system can't be disabled because the two resistor switch and wiring are under the locked hood. A third advantage is that the lock only works when the current is applied. If the vehicle's battery goes dead for some reason, the hood is automatically unlocked since there would be no current to keep it locked.

If desired, the lock can be slightly changed so that the lock is unlocked when the current is applied to the electromagnet. This is done as shown, by using a spring to keep the vertical bar in the vertical position. When the current is applied, the vertical bar is pulled out of the vertical.

As shown, a toggle switch 55 can be placed between the ignition and the electromagnet, so that the lock can only be unlocked when the ignition and the toggle switches are on. If desired, a bar connected to the vertical bar and extending through the mechanism housing can be added so the vertical bar can be pulled aside by hand if the battery is dead and there is no current to unlock the lock. This mode of operation is not recommended, however, since the lock can also be unlocked by hand by a car thief, thus defeating the purpose of the lock.

Figure 3:
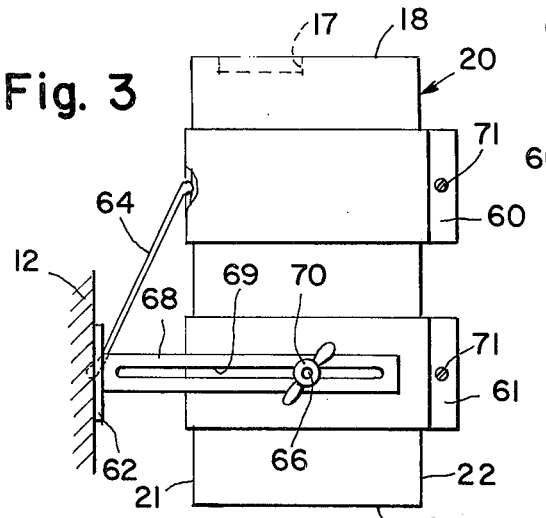
FIG. 3 is a side elevational view of the locking mechanism housing as attached to the motor vehicle body or chassis.
Figure 4:
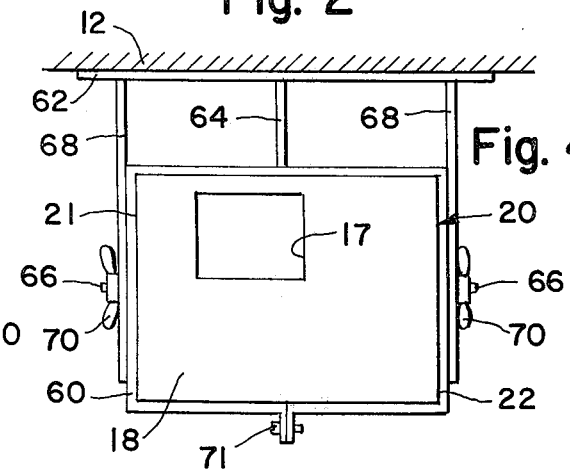
FIG. 4 is a top plan view of the locking mechanism housing as attached to the vehicle body or chassis.
Figure 6:
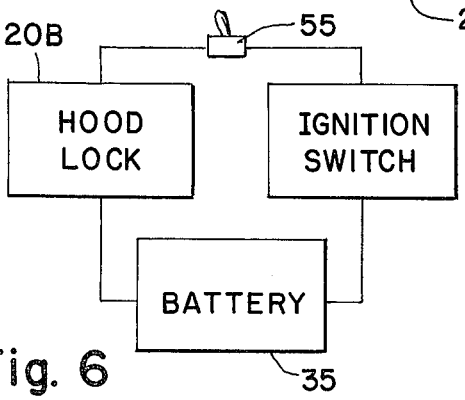
FIG. 6 is a block and schematic diagram of a form of the invention in which the electromatic means unlocks the hood.

Referring now to FIGS. 3 and 4, the hood lock is mounted as follows. The locking mechanism housing 20 has two collars 60 and 61 which are attached to a plate 62, which is attached to the body of the car in the engine compartment. The upper collar 60 is attached to the plate 62 by a tie bar 64 attached to the middle of the plate. The tie bar is attached to the plate and collar by two joints that allow the bar to swivel up and down. The second collar 61 has two bolts 66 protruding from the sides. The bolts fit into two bars 68 that are attached to the plate 62 at a ninety degree angle as seen in FIG. 3, and the two bars have an opening 69 the length of the bar and the width of the bolts. The collar can be slid along the length of the bar and locked into position by tightening a wing nut 70 on the bolt. The collars are tightened around the locking mechanism housing by a screw 71 in front of the collars. When the screw is turned it pulls the two edges of the collars tightly around the locking mechanism housing.

The top bars 14 are attached to the hood as explained and shown. This mounting arrangement allows the locking mechanism and top hooked bar attached to the hood to be adjusted so they can be properly joined in various car and truck models.

While a specific description of the invention has been set forth herein, it is understood that various changes may be made in size, shape, materials and arrangement without departing from the spirit and scope of the invention as claimed.

Having herein described the invention, what is claimed as new is:

1. A locking device for a vehicle hood and the like, which comprises:

a. a main locking mechanism housing having a plurality of walls, a main chamber therein, and an entrance opening formed in one of said walls;

b. anchoring means for securing said housing to an interior of a hooded vehicle compartment;

c. a movable elongated latch bar member contained in said housing, said movable elongated latch bar member having an enlarged upper end making said bar member slightly top heavy, said latch bar member pivoted intermediate said enlarged upper end and a lower end;

d. a locking bar post securable at its upper end to said vehicle hood, said bar post of an EL shape to form a latching finger at its lower end, said locking bar post and said latching finger extensible through said entrance opening into said main chamber;

e. a latching means carried on said enlarged upper end of said latch bar member for releasably lockingly engaging with said latching finger of said locking bar post for holding the same against being unlocked when said latch bar member is moved into locking position; and f. electromagnetic means contained in said housing beside said lower end of said bar member.

2. The construction of claim 2, and wherein said enlarged upper end of said bar member has an opening formed therein for engaging over and around said latching finger of said bar post, for holding said finger in locked position when said bar member is moved into locking position.

3. The construction of claim 2, and wherein said elongated latch bar member comprises an EL shaped lower foot portion at its lower end, a swing ferrous metal plate suspended from said lower foot portion, said electromagnetic means connectable to a source of electricity for attracting said metal plate on being energized, to draw said lower foot portion toward said electromagnetic means and to swing and rotate said entire elongated latch bar member counterclockwise for locking engagement of its upper end with said latching finger to lock the hood.

4. The construction of claim 3, and comprising spring means for biasing said elongated latch bar member toward disengagement with said latching finger for aiding disengagement upon deactivation of said electromagnetic means.

5. The construction of claim 2, and wherein said elongated latch bar member comprises an EL shaped latching lever on its upper end portion for engaging with said latching finger on swinging rotation of said elongated latch bar member toward said latching finger, said elongated latch bar member comprising an EL shaped lower foot portion, a ferrous metal swing plate suspended from said lower foot portion, electromagnetic means connectable to a source of electricity for attracting said swing plate to rotate said elongated latch bar member clockwise out of locking engagement with said latching finger on activation of electromagnetic means, for unlocking said hood.

6. The construction of claim 1, and comprising a plurality of holding collars for holding and encircling said housing means, wall plate means engageable with a wall of said vehicle compartment, first rod means pivotally secured at one end to said wall plate means and at the other end to an upper one of said holding collars, and slide plate means extending from said wall plate means and having an elongated slot overlying a side of said lower holding collar, and bolt means extending from said holding collar and through said slot for adjustably positioning said collar.

* * * * *